US006752122B2

(12) United States Patent
Yuya

(10) Patent No.: US 6,752,122 B2
(45) Date of Patent: Jun. 22, 2004

(54) COMBUSTION CONTROL APPARATUS AND METHOD FOR SPARK-IGNITED INTERNAL COMBUSTION ENGINE

(75) Inventor: Masahiko Yuya, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 62 days.

(21) Appl. No.: 10/137,639

(22) Filed: May 3, 2002

(65) Prior Publication Data

US 2002/0179038 A1 Dec. 5, 2002

(30) Foreign Application Priority Data

May 30, 2001 (JP) ..... 2001-162130

(51) Int. Cl.[7] ..... F02D 41/30; F02D 41/24; F02D 41/02

(52) U.S. Cl. ..... 123/295; 123/305

(58) Field of Search ..... 123/295, 305

(56) References Cited

U.S. PATENT DOCUMENTS 6,145,490 A * 11/2000 Heidenfelder et al. ..... 123/295

6,325,041 B1 * 12/2001 Mamiya et al. ..... 123/305

FOREIGN PATENT DOCUMENTS

| | | |
|---|---|---|
| JP | 11-125131 | 5/1999 |
| JP | 2000-234542 | 8/2000 |

* cited by examiner

*Primary Examiner*—Mahmoud Gimie
*Assistant Examiner*—Arnold Castro
(74) *Attorney, Agent, or Firm*—Foley & Lardner LLP

(57) ABSTRACT

In combustion control apparatus and method for a spark-ignited internal combustion engine, a counter is set to correspond to a drive time duration from a time at which a combustion drive state of the engine is started to be in a stratified combustion drive state to a time immediately before a smolder of a spark plug occurs in a state of which a spark is emitted between an outer electrode of the spark plug and a carbon deposited on an insulator porcelain thereof, a determination of whether it reaches to a time at which the stratified combustion drive state is inhibited is executed on the basis of a value of the counter, and the combustion drive state is forcibly switched from the stratified combustion drive state to a homogeneous combustion drive state when such a determination is carried out that it reaches to the time at which the stratified combustion drive state is inhibited.

20 Claims, 10 Drawing Sheets

COMBUSTION CONTROL APPARATUS AND METHOD FOR SPARK-IGNITED INTERNAL COMBUSTION ENGINE

BACKGROUND OF THE INVENTION (1) Field of the Invention

The present invention relates to combustion control apparatus and method for a spark-ignited internal combustion engine, particularly, in which a stratified combustion drive is carried out.

(2) Description of the Related Art

Two Japanese Patent Application First Publications No. Heisei 11-125131 published on May 11, 1999 and 2000-234542 published on Aug. 29, 2000 exemplify previously proposed combustion control apparatuses for the spark-ignited internal combustion engine in which a nozzle of a fuel injector and a spark plug are exposed to a combustion chamber of each cylinder and a whole engine drive region is divided into two sub-regions depending upon a load imposed on the engine, one drive region being a low load region in which a stratified combustion drive is carried out and the other region being a high load region in which a homogeneous combustion drive is carried out.

SUMMARY OF THE INVENTION

It is well known that the spark plug becomes easy to be smoldered because a high temperature cannot be obtained in the stratified combustion drive state as is different from the homogenous combustion drive state. Mechanism of developing the smolder of the spark plug will be described with reference to FIGS. 3A and 3B which show expanded views of a tip portion of the spark plug exposed to the combustion chamber. Most parts of a center electrode 21 of the spark plug is covered with an insulator porcelain 22 and an outer electrode 24 is disposed so as to face against a tip portion 21*a* of center electrode 21 projected slightly toward a lower end of insulator porcelain 22 with a predetermined gap 23.

In a state in which no smolder state of spark occurs on the spark plug, an air around a part of the outer electrodes 24 which is nearest to outer electrode 24 from tip portion 21*a* (a lower portion as viewed from FIGS. 3A and 3B) of center electrode 21 is broken down and a spark is emitted. In the stratified combustion drive state which is not easy to obtain a high temperature, a carbon left burned on surfaces of tip portion 21*a* of center electrode 21 and insulator porcelain 22 is deposited thereon. Since the carbon is a good conductor, a high voltage supplied to center electrode is leaked onto this deposited carbon. Hence a spark begins to be emitted toward a side direction (leftward as viewed from FIG. 3B) if deposited carbon 25 becomes thick, to some degree, as shown in FIG. 3B. This is, as shown in FIG. 3B, the smolder state.

Japanese Patent Application First Publication No. Heisei 11-125131 published on May 11, 1999 exemplifies one of the two previously proposed combustion control apparatuses in which when the secondary voltage is detected and the secondary voltage is determined to be reduced by a value equal to or lower than a predetermined value, a misfire has occurred, the stratified combustion drive is inhibited, and the combustion drive state is switched from the stratified combustion drive to the homogeneous combustion drive. A secondary voltage, viz., a voltage between center electrode 21 and outer electrode 24 is reduced during the occurrence of the smolder state.

However, it is noted that, since a state shown in FIG. 3B indicates an abrupt reduction in the secondary voltage, FIG. 3B shows a state wherein the misfire has occurred. That is to say, the method of detecting the misfire is a detection of the occurrence of the misfire and an immediate state before the misfire cannot be made. Once the combustion chamber falls in a misfire state, it requires a time for the firing state of fuel to be recovered from the misfire.

Since, in this case, there is provided a close relationship between the smoldering and the insulation resistance in the spark plug (a resistance between center electrode 21 and insulator porcelain 22), the insulation resistance of the spark plug may be considered to be adopted as a parameter of a prevention of the misfire in place of the secondary voltage. FIG. 4 shows a model representing influences of the insulation resistance and the secondary voltage against the misfire. As shown in FIG. 4, a resistance value of the insulation resistance of the spark plug reaches to a misfire region at an earlier timing than the resistance corresponding to the secondary voltage with respect to an elapsed time. This means that a method of detecting the misfire from the insulation resistance can detect a state immediate before the occurrence of the misfire with the secondary voltage. As described above, the insulation resistance is superior in detecting the state immediately before the occurrence of the misfire. However, the method of detecting the insulation resistance in an actually engine mounted vehicle is not developed although the insulation resistance can be detected experimentally.

It is, hence, a main object of the present invention to provide combustion control apparatus and method for a spark-ignited internal combustion engine in which the ignition state of fuel during the stratified combustion drive is retained at a state immediately before the smolder occurs to suppress a worsening of a combustion stability at minimum by introducing a counter set to correspond to a drive time duration until a time immediately before the spark is emitted between the outer electrode of the spark plug and deposited carbon on the insulator porcelain, determining whether it is a time at which an inhibit of the stratified combustion drive state on the basis of a value of the counter, and switching forcibly a combustion drive state to the homogenous combustion drive when determining that it is the time at which the inhibit of the stratified combustion drive state. It is another object of the present invention to provide combustion control apparatus and method for a spark-ignited internal combustion engine in which a recovery of the insulation resistance of the spark plug after the inhibit of the stratified combustion drive can be speedily be carried out to return the combustion drive state to the stratified combustion drive by introducing another counter set to correspond to the drive time duration until the insulation resistance of the spark plug is recovered to its original value during the homogenous combustion drive, determining whether it is a time at which the inhibit of the stratified combustion drive is released on the basis of the value of the other counter, and releasing the inhibit of the stratified combustion drive.

This summary of the invention does not necessarily describe all necessary features so that the invention may also be a sub-combination of these described features.

DETAILED DESCRIPTION OF THE PREFERRED EMBODIMENT

Reference will hereinafter be made to the drawings in order to facilitate a better understanding of the present invention.

Figure 1A:
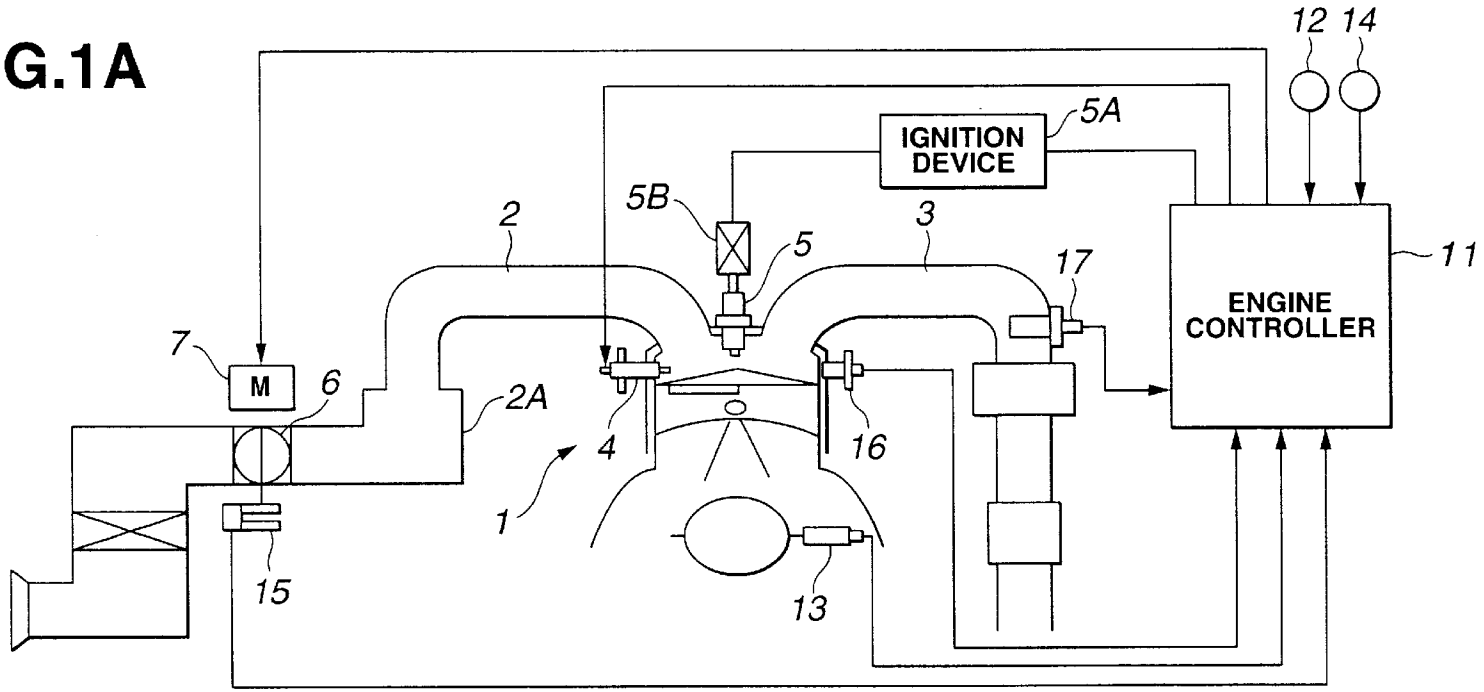
FIG. 1A is a configuration view of a spark-ignited internal combustion engine to which a combustion control apparatus in a preferred embodiment according to the present invention is applicable.

FIG. 1A shows a configuration view of a spark-ignited internal combustion engine to which a combustion control apparatus in a preferred embodiment according to the present invention is applicable. In FIG. 1A, an engine main body designated by a reference numeral 1 is provided with an intake air passage 2, an exhaust passage 3, a fuel injection valve (fuel injector) 4, an ignition plug 5, a throttle valve 6, and a throttle valve controller 24 (for example, a stepping motor or a DC motor) which controls electronically an opening angle of throttle valve 6. Fuel injector 4 whose nozzle portion is exposed directly to each cylinder injects fuel at a time of a latter half of a compression stroke of each cylinder directs an air mixture fuel formed from its spray towards spark plug 5 in a form of mass utilizing an intake air ripple within the corresponding cylinder. Then, a spark is carried out for spark plug 5 in a form of fuel mixture air mass reached to a proximity to a spark plug in the vicinity to a compression stroke upper top dead center so that a drive under a super thin combustion (in a stratified combustion) exceeding, for example, 40 as a whole is carried out. In addition, the fuel is injected at a suction stroke under a high load so as to make a mixture of air to fuel earlier so that a homogenous air mixture fuel over a whole area of the corresponding engine cylinder is satisfied and a homogenous combustion drive by means of air mixture fuel in a stoichiometric air fuel ratio is carried out.

Figure 2:
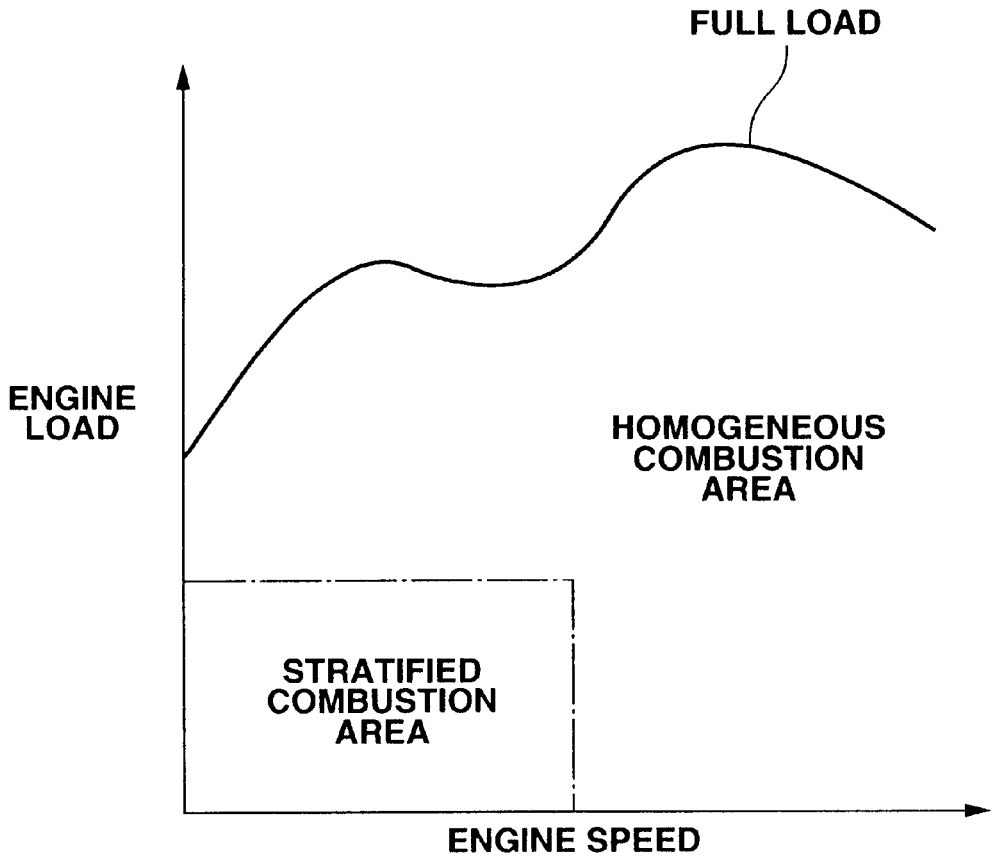
FIG. 2 is a characteristic graph representing a drive region of a stratified combustion drive state and a homogenous combustion drive state.

Therefore, a signal representing an accelerator opening angle from an accelerator opening angle sensor 12, a signal representing a position for each unit angular displacement and a reference signal for each phase difference from a crank angle sensor 13, a signal representing an intake air quantity from an airflow meter 14, a signal of a coolant temperature from a coolant temperature sensor 16 are inputted into an engine controller 11. Engine controller 11 controls a fuel injection quantity and an injection timing from fuel injector 4 so as to obtain optimum air-fuel mixture ratio and optimum combustion state according to the driving condition (determined according to engine speed and intake air quantity). For example, if the engine driving condition falls in the stratified combustion region as shown in FIG. 2, the injection timing is set at the latter half of the compression stroke during which the piston is moved upward and air-fuel ratio is set to a thinner direction than a stoichiometric air fuel ratio. On the other hand, if the engine driving condition falls in a homogenous combustion region shown in FIG. 2, the fuel injection timing is set to the suction stroke during which the corresponding piston is moved downward and the air-fuel mixture ratio is set within a narrow range with the stoichiometric air-fuel ratio as a center.

In addition, an opening angle of throttle valve 6 is controlled so as to obtain a torque in accordance with the driving condition (determined according to engine speed and accelerator opening angle). At this time, a signal from a throttle sensor 15 is used as a feedback signal.

Engine controller 11 controls a timing (ignition timing) at which a discharge across a discharge gap of spark plug 5 is started. That is to say, since, over a stratified combustion area, an optimum ignition timing is different depending upon the engine speed and engine load of the engine, engine controller 11 calculates the optimum ignition timing according to the engine speed and engine load and the ignition signal (transistor drive signal) which corresponds to the calculated ignition timing is outputted to a power transistor to turn a primary current of a corresponding ignition coil to ON and OFF. When an electromagnetic energy in accordance with the primary current is stored by turning the power transistor to ON before the ignition timing. When it is the ignition timing of the corresponding engine cylinder and the power transistor of an ignition device 5A is turned to OFF, a high surge voltage is induced on a secondary winding of the corresponding ignition coil, the discharge is started at a time at which the high surge voltage has reached to a discharge start voltage of the discharge gap connected serially to the secondary circuit, the discharge being continued for a predetermined time duration.

Figure 1B:
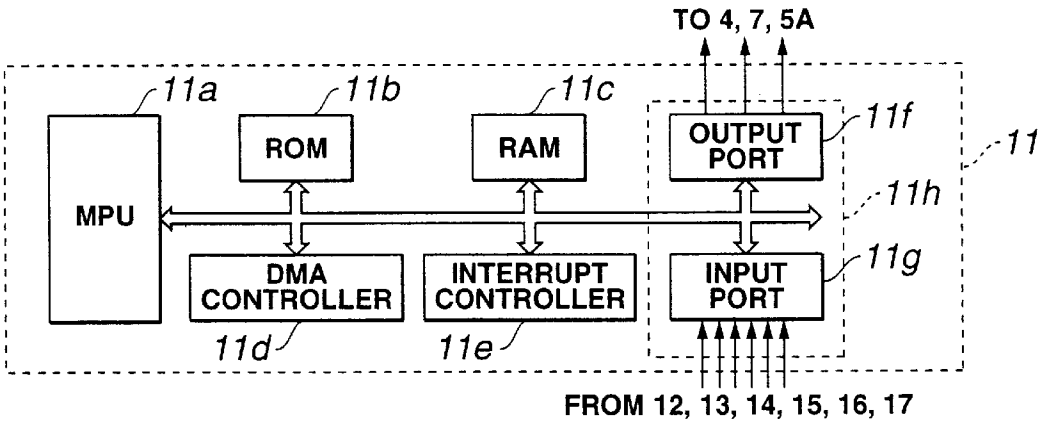
FIG. 1B is a circuit block diagram of an engine controller shown in FIG. 1A.

It is noted that engine controller 11, as shown in FIG. 1B, includes a microcomputer having a MPU 11*a* (Microprocessor Unit), ROM (Read Only Memory) 11*b*, a RAM (Random Access Memory) 11*c*, a DMA (Direct Memory Access) controller 11*d*, an Interrupt Controller 11*e*, an Input/Output Interface 11*h* having an input port 11*g* and an output port 11*f*, and a common bus.

Figure 3A:
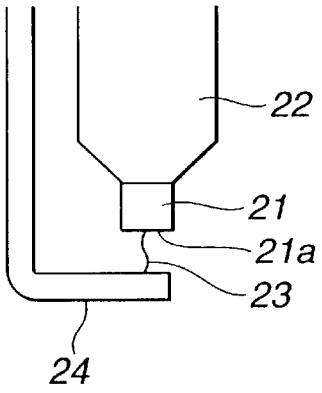
FIGS. 3A and 3B are expanded views of a tip portion of a spark plug in a cylinder of the engine shown in FIG. 1A.
Figure 3B:
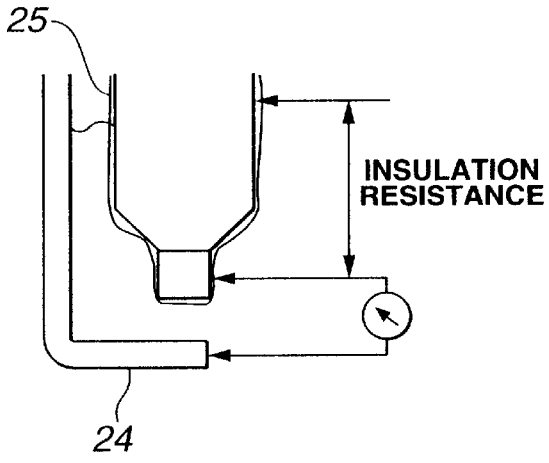

It is well known that there is a tendency that spark plug 5 smolders since the high temperature is not obtained in the case of the stratified combustion drive as is different from the homogenous combustion drive. A mechanism in which the smoldering is developed will be described with reference to FIGS. 3A and 3B. FIGS. 3A and 3B show expanded views of a tip portion of the spark plug exposed to the combustion chamber. Most of center electrode 21 of spark plug 5 is covered with insulator porcelain 22. An outer electrode 24 is disposed over a tip portion 21*a* of center electrode 21 projected slightly downward as viewed from FIG. 3A with the predetermined gap.

The spark is emitted by breaking down the air at a part of space from tip portion 21*a* of center electrode 21 to a nearest part (lower portion as viewed from FIG. 3A) of outer electrode 24 when no smolder state occurs in spark plug 5, as shown in FIG. 3A.

A carbon left burned is deposited on surfaces of tip portion 21*a* of center electrode 21 and of insulator porcelain 22 in the stratified combustion which is not easy to obtain the high temperature. Since the carbon is a good conductor, the high voltage supplied to the center electrode 21 is leaked onto the deposited carbon. Hence, the spark starts to be emitted from the insulator porcelain 22 to outer electrode 24 positioned at a side portion (leftward as viewed from FIGS. 3A and 3B). This state means soldering.

Hence, since the secondary voltage which is a voltage between center electrode 21 and outer electrode 24 is reduced when the smolder occurs, engine controller 11 detects the secondary voltage, determines that the misfire will occur when the detected secondary voltage is reduced to a value equal to or below a predetermined value, and inhibit the stratified combustion so as to be switched to the homogenous combustion drive. However, since, in the state shown in FIG. 3B, the secondary voltage is abruptly decreased. This indicates the occurrence of the misfire. That is to say, the method of detecting the misfire on the basis of the secondary voltage is resulted in the detection of the occurrence in the misfire and cannot detect an immediate state before the occurrence of misfire.

Figure 4:
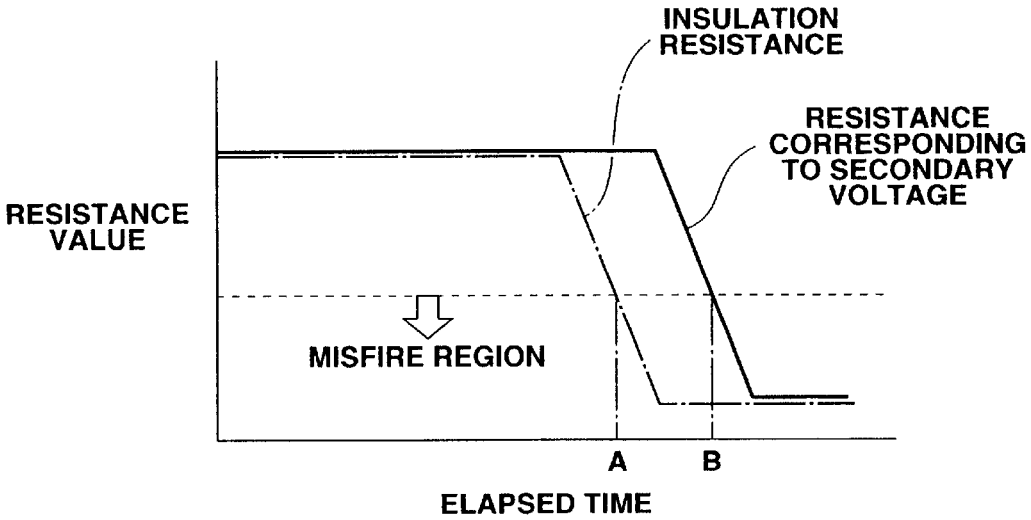
FIG. 4 is a characteristic graph representing a variation of resistance values of an insulation resistance and of a secondary voltage.

Since a close relationship between the smoldering and an insulation resistance of spark plug (hereinafter, referred simply as to an insulation resistance) is established, in the combustion control apparatus according to the present invention, this insulation resistance is adopted as a parameter to prevent the occurrence of misfire in place of the secondary voltage. It is noted that the influence of the insulation resistance and secondary voltage on the misfire is shown by a model of FIG. 4. As shown in FIG. 4, the insulation resistance becomes reduced at an earlier time than the resistance corresponding to the secondary voltage. This means that the method of detecting the misfire from the insulation resistance can detect the state immediately before the misfire at a time faster than that from the secondary voltage.

As described above, the insulation resistance is superior in detecting the state immediate before the misfire at an earlier timing. Although the insulation resistance can be detected experimentally, no method of detecting the insulation resistance in an actual automotive vehicle has been developed.

On the other hand, it is well known that a reduction speed of the insulation resistance during the stratified combustion drive time duration (an elapsed time for which the engine drive is continued until a combustion stability is worsened) is dependent upon parameters of the air fuel ratio, fuel vaporization time, combustion chamber temperature, and so forth. Qualitatively speaking, the insulation resistance becomes easier to be reduced as the engine load becomes higher and the air fuel ratio becomes richer, as the vaporization time becomes shorter, and as the combustion chamber temperature becomes lower. In the stratified combustion drive region, as the engine load becomes higher, the air fuel ratio is set to become richer. With this setting of the air fuel ratio taken into consideration, a reduction speed of the insulation resistance during the stratified combustion drive is varied as shown in FIG. 5 when these characteristics are represented on a drive region.

Figure 5:
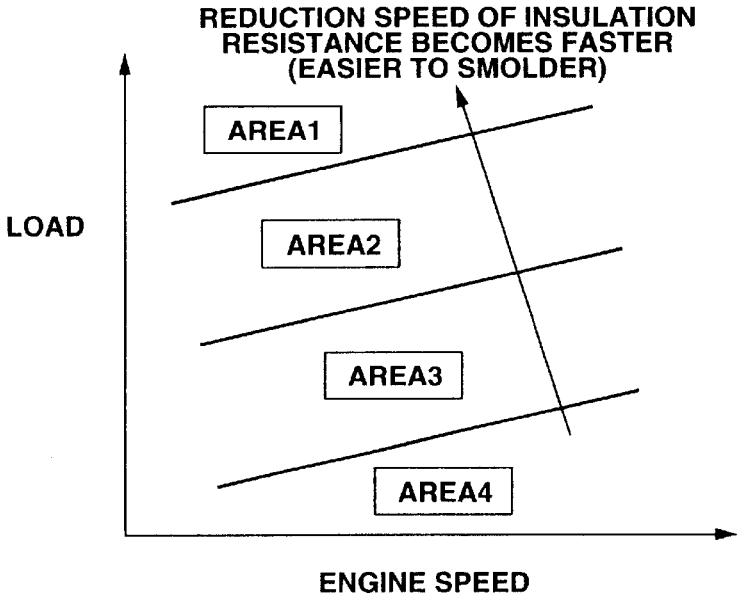
FIG. 5 is a regional view representing a distribution of a reduction speed of the insulation resistance during the stratified combustion drive.

That is to say, in FIG. 5, the drive region of the engine is divided into four of area 1, area 2, area 3, and area 4. As the engine speed becomes lower and the engine load becomes higher, the reduction speed of the insulation resistance becomes larger (which means that becomes easier to be smoldered).

Figure 6:
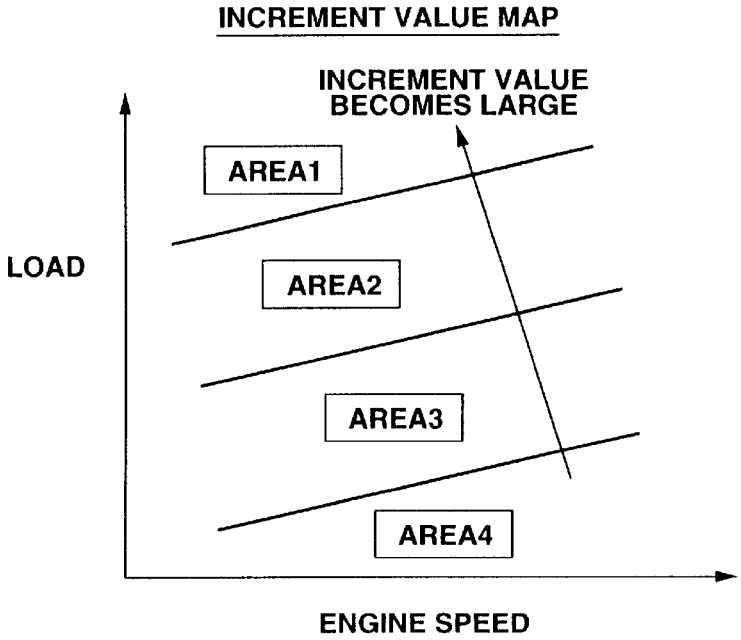
FIG. 6 is a characteristic graph representing a map of a value of increment of a counter of the combustion control apparatus shown in FIG. 1A.

According to the present invention, the counter which is incremented so as to correspond to the drive elapsed time in the stratified combustion drive region is introduced, a counter increment value per unit time (an increment rate of the counter) is set as shown in FIG. 6 so that a single upper limit value of the counter meets every drive elapsed time although the engine driving condition is different.

When the value of counter becomes equal to or higher than the upper limit value of the counter, the ignition state (refer to FIG. 3B) in which the spark is emitted between the outer electrode and deposited carbon on the insulator porcelain is defined as the state of smolder and controller 11 determines that the ignition state becomes a state immediately before the smolder (hereinafter, referred to as smolder immediate prior state), and transfers forcibly the combustion drive state into the homogeneous combustion drive by inhibiting the stratified combustion drive.

A detailed description of a reason of setting the counter increment value per unit time (referred simply to as counter increment value) as shown in FIG. 6 will be made below.

Figure 11:
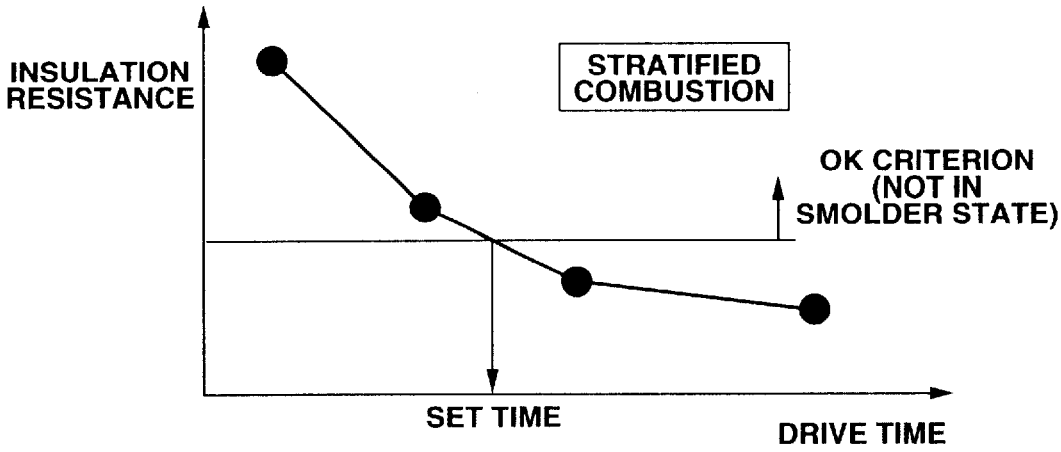
FIG. 11 is a characteristic graph representing a relationship between a drive time duration and the insulation resistance during the stratified combustion drive.

FIG. 11 represents a relationship between the drive time duration in the stratified combustion drive and insulation resistance. As shown in FIG. 11, the insulation resistance becomes lower as the drive time duration becomes longer.

If, in this characteristic, the insulation resistance corresponding to the smolder immediate prior state is set as an OK criterion (also called, threshold value), it is possible to perform the stratified combustion drive until the insulation resistance reaches to the OK criterion. That is to say, with the drive time duration at which the insulation resistance has reached to the OK criterion set as a set time as shown in FIG. 11, it is necessary to determine this set time in such a way that even if the driving condition becomes different, the drive time duration is not in excess of OK criterion.

Figure 12A:
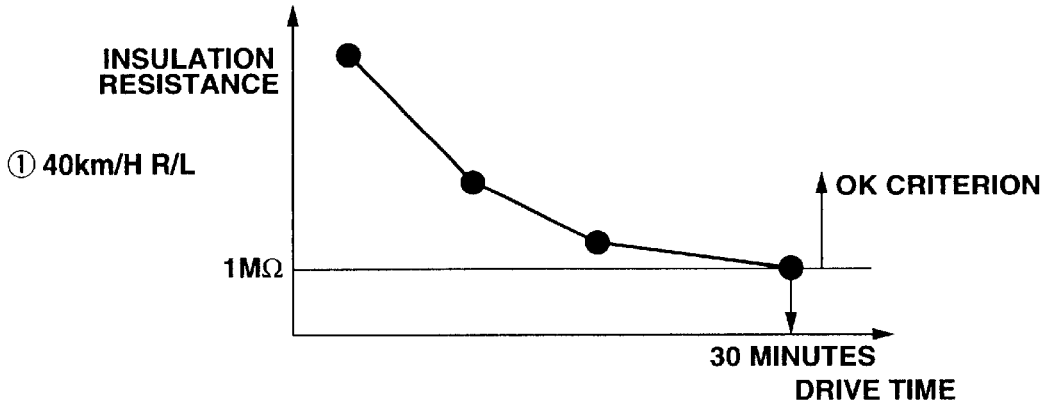
FIGS. 12A through 12C are characteristic graphs representing variation patterns of a relationship between the drive time duration and the insulation resistance according to the engine driving condition.
Figure 12B:
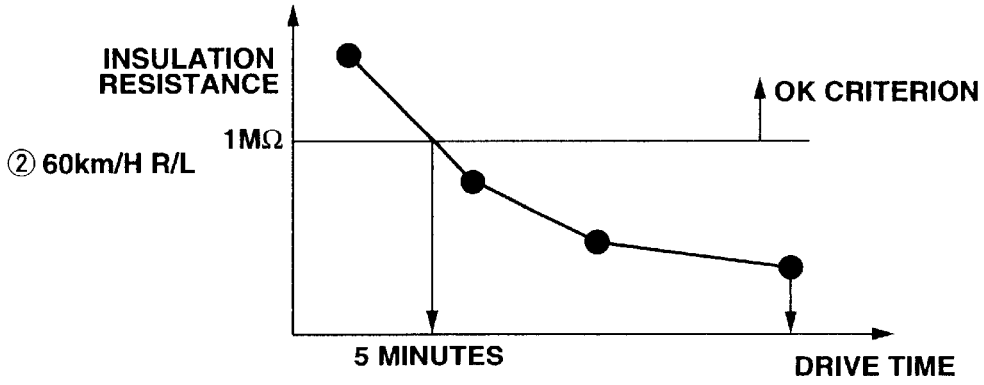

Suppose now an example of how a relationship between the drive time duration and insulation resistance is varied dependent upon the engine driving condition. That is to say, at the engine driving condition of ① (during a vehicular run of road-to-road at 40 Km/h) shown in FIG. 12A even though OK criterion (for example, 1 MΩ) is not varied, it is possible to drive the engine in the stratified combustion for 30 minutes without giving a worsening of driveability. On the other hand, under the engine driving condition of ② shown in FIG. 12B (during the vehicular run of road-to-road at 60 Km/h) or under the engine driving condition of ③ shown in FIG. 12B (engine idling), a more drive of five minutes or ten minutes can cause the worsening of driveability. That is to say, the drive time durations until it reaches to a state immediately prior to the smoldering are different as 30 minutes, 5 minutes, and 10 minutes according to the respective engine driving conditions of ① through ③ as shown in FIG. 12. Hence, if the setting times are defined for the respective driving conditions, the settings of the setting times becomes complex. In the combustion control apparatus according to the present invention, together with the introduction of the counter which increments so as to correspond to the drive time duration in the stratified combustion drive region, only one upper limit value of the counter which cannot meet the setting time which is different according to the engine driving condition but can be met even through the engine driving condition is different.

Figure 12C:
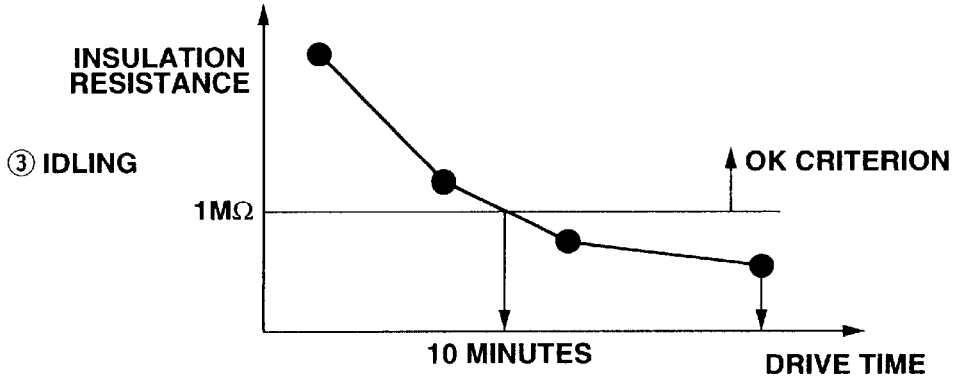

Therefore, a multiple of a longest time duration from among the drive time durations until it reaches to the smoldering immediate prior time is determined as the upper limit value of the counter. Since, in the example of FIGS. 12A through 12C, the longest time from among the drive time durations of 30 minutes, 5 minutes, and 10 minutes until it is the smoldering immediate prior state is 30 minutes (=1800 seconds), 18000 [an absolute number] of ten multiple of 30 minutes (=1800 seconds) is the upper limit value of the counter. The reason of selecting ten multiple is that the difference between engine models is taken into consideration. For example, in a case of another engine model than that from which the data in FIGS. 12A through 12C are obtained, the longest time from among the drive time durations until it reaches to the smoldering immediate prior state may indicate 25 minutes. The reason is that, if the number of seconds (1800) of the longest time from among the drive time durations until it reaches to the smoldering immediate prior state were set to the upper limit value of the counter, the counter increment value (as will be described later) cannot be set by an integer. Hence, any multiple of 1800 is set to the upper limit value of the counter so that an integer can be adopted as the counter increment value even if the engine model is different. Specifically, the following result is obtained when a value to be added to the counter per second in each of the three driving conditions is calculated.

Driving condition of ① (drive time duration to become the smoldering immediate prior state: 30 minute=1800 seconds) counter increment value=18000÷1800[second]=10 [/seconds]

Driving condition of ② (drive time duration to become smoldering immediate prior state: 5 minutes=300 seconds) counter increment value=18000÷300[second]=60[/second]

Driving condition of ③ (drive time duration to become the smoldering immediate prior state: 10 minutes=600 seconds) counter increment value=18000÷600[seconds]=30 [/seconds].

As described above, the drive time duration to reach to the smoldering immediate prior state is measured in the same way as described in FIG. 12 and is measured for each engine driving condition, the increment value of the counter is calculated for each engine driving condition and the data of the increment value of the counter for each engine driving condition is plotted on a drive region to obtain a characteristic shown in FIG. 6 and only one counter increment value is given to the same area so as not to give influences on the memory capacity and calculation load.

Figure 13:
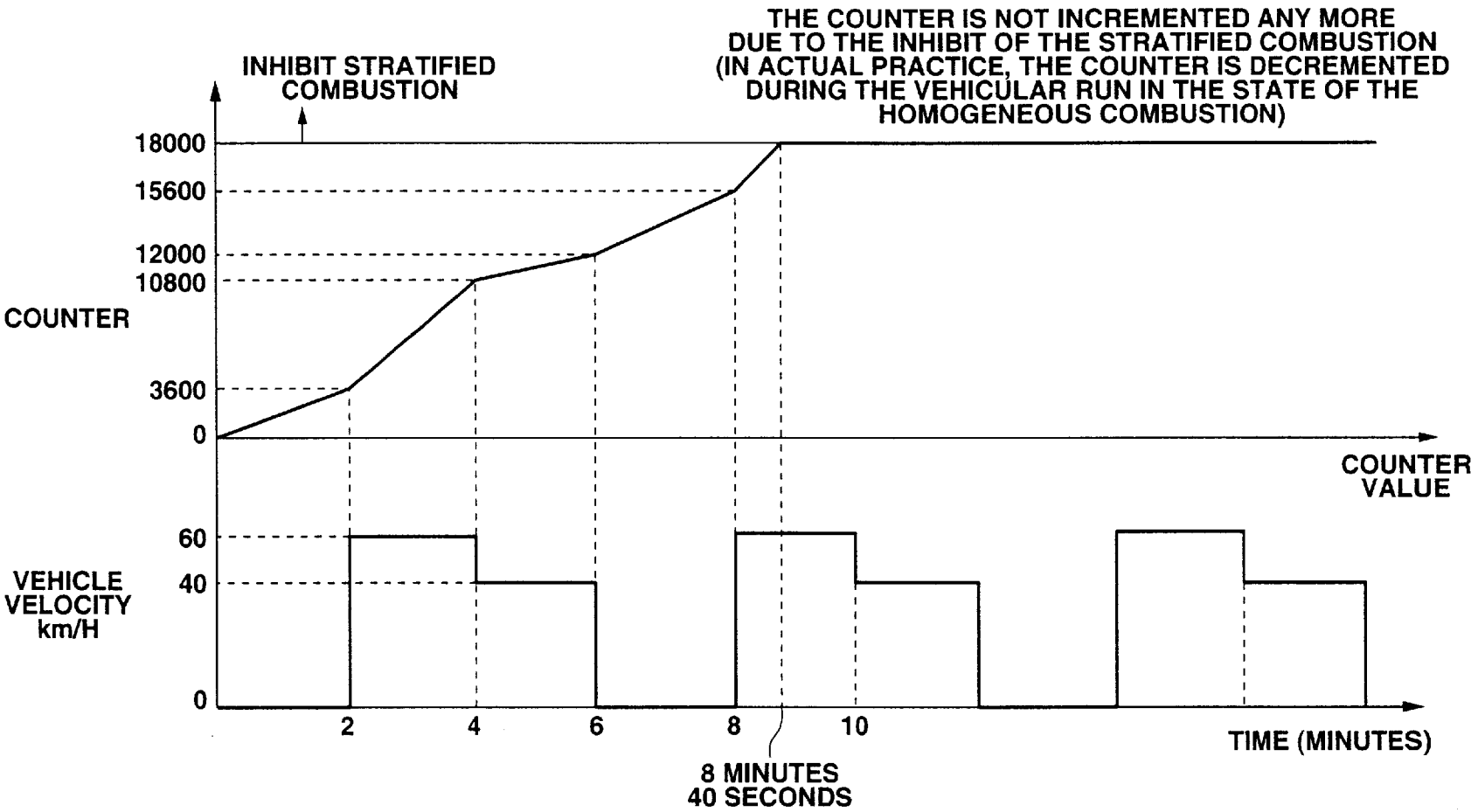
FIG. 13 is a waveform chart representing a history of the counter during an actual run of a vehicle in which the combustion control apparatus in the preferred embodiment according to the present invention is mounted.

Next, FIG. 13 shows a history of the contents of the counter during an actual vehicular run in a case where the conditions of ① through ③ are combined in such a sequence as ③, ②, and ① as one set and this set is repeated. In FIG. 13, since the drive time duration under the engine driving condition of ③, ②, and ① is two minutes each (=120 seconds), the condition of ③ is continued for two minutes, the counter value of the counter is incremented by 3600 (30[/seconds]×120[seconds]). If the condition of ② is continued for two minutes, the count value of the counter is incremented by 7200 (=60[/seconds]×120 [seconds]=7200. If condition of ① is continued for two minutes, the count value of the counter is incremented by 1200 (=10[/seconds]×120[seconds]). Consequently, in this example, after 8 minutes and 40 seconds, the count value of the counter reaches to 18000 of the upper limit value of the counter so that the stratified combustion drive is inhibited.

As described above, if both of the upper limit value of the counter and of the increment value of the counter are previously set, a more advance of the smoldering can be prevented from occurring at a state before the combustion chamber falls in such a smoldering state as shown in FIG. 3B irrespective of the engine driving condition.

In other words, since upper limit value of KSBFULL of the counter is set so as to switch the combustion drive state to the homogenous combustion drive before the smoldering is advanced to a state shown in FIG. 3B and the combustion stability becomes worsened, the reduction in the insulation resistance to a degree such as to worsen the combustion stability can be suppressed and the worsening of driveability can be prevented from occurring.

Next, if the combustion drive is forcibly switched to the homogenous combustion drive, the deposited carbon shown in FIG. 3B is combusted and vanishes (autopurification) according to the homogenous combustion drive in which the high temperature can be obtained. The reduced insulation resistance of the spark plug is recovered to an original large value. It is well known that the speed of recovery of the insulation resistance is dependent upon the parameters such as spark plug temperature and the number of ignitions per unit time. Qualitatively speaking, as the engine load becomes higher and the plug temperature becomes higher, the recovery speed of the insulation resistance becomes faster. In addition, as the engine speed becomes higher and the number of times the ignition occurs, the recovery speed of the insulation resistance becomes fast. Hence, the speed of the recovery of the insulation resistance (a time it takes for the insulation resistance to be recovered) is varied which represents the above-described characteristic on the drive region.

Figure 7:
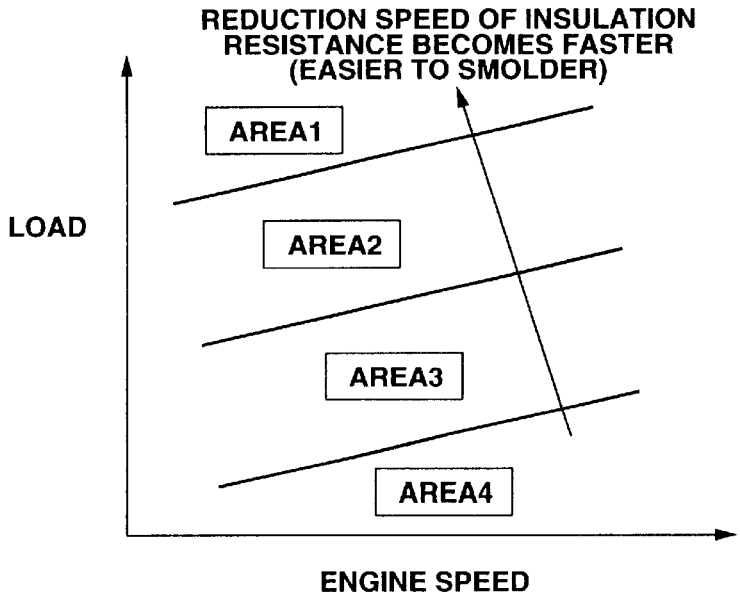
FIG. 7 is a regional view representing a distribution of a recovery speed of the insulation resistance during the homogenous combustion drive after the stratified combustion drive.

FIG. 7 shows the drive region generally into four areas of A, B, C, and D. As shown in FIG. 7, as the engine speed becomes higher and as the engine load becomes higher, the recovery speed of the insulation resistance becomes faster (the recovery from the smolder is fast). In this case, since the drive time duration in the homogenous combustion drive region is represented by the increment of the counter as described above, the drive time duration during which the homogenous combustion drive is carried out may be represented by a decrement of the counter. Then, only one counter lower limit value is defined which can meet every requirement even if the driving condition is different. The definition of this counter lower limit value is made in the same way as described with reference to FIGS. 11 and 13. The drive time duration for the insulation resistance to be recovered to its normal (original) state is measured in the same way as described with reference to FIGS. 12A through 12C for each engine driving condition. A multiple of the number of seconds which is the longest from among the drive time durations for this insulation resistance to be recovered to its normal state is determined as the lower limit value of the counter. Each drive time duration for the insulation resistance to be recovered to its original normal value and the lower limit value of the counter are used to calculate a decrement value of the counter per unit time (hereinafter, referred simply to as "a counter decrement value" for each engine driving condition). If the data on the decrement value of the counter for each engine driving condition is plotted on the drive region, characteristic of FIG. 8 can be obtained.

If the value of the counter becomes equal to or lower than the lower limit value of the counter, engine controller 11 determines that the insulation resistance is recovered to its normal state and allows the stratified combustion drive. As described above, if the lower limit value of the counter and the decrement value thereof are previously set, suppose such a case where the stratified combustion drive is inhibited, the homogeneous calculation drive is carried out, and, upon the elapse of a constant period of time irrespective of the engine driving condition, the stratified combustion is allowed. As compared with the case described above, the time to inhibit the stratified combustion drive can be suppressed at minimum. Then, the worsening of the actual fuel consumption can be minimized.

Figure 9:
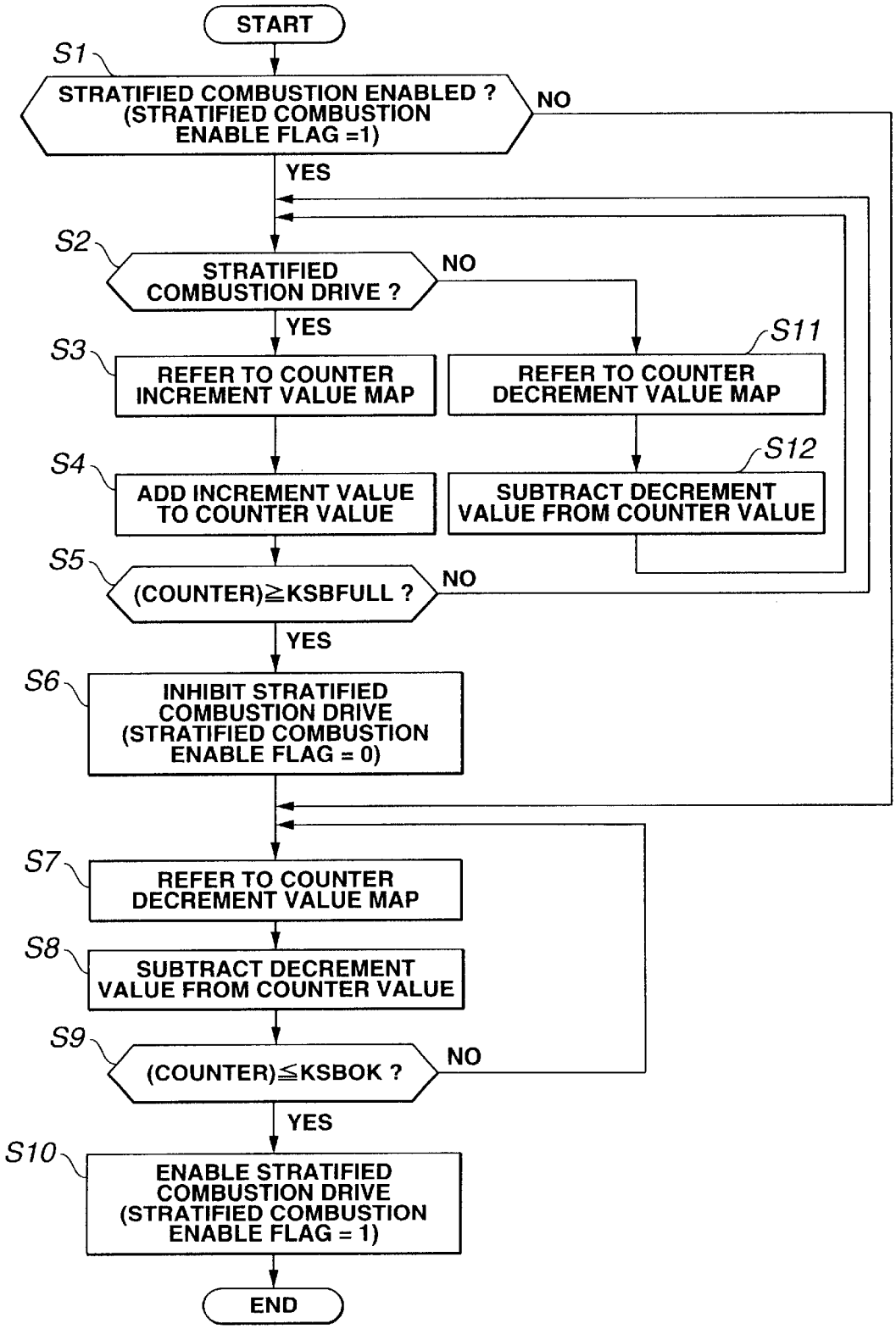
FIG. 9 is an operational flowchart for explaining a control of prevention of a misfire executed by an engine controller of the combustion control apparatus in the preferred embodiment.

Next, FIG. 9 shows an operational flow chart of the control contents of the prevention of them is fire carried out by engine controller 11.

At a step S1, engine controller 11 determines if the stratified combustion is allowed (enabled) according to a state of a stratified combustion enable flag. The stratified combustion enable flag is a flag newly introduced in the preferred embodiment of the combustion control apparatus. In this case, in order to start the drive from the stratified combustion enable state, the stratified combustion enable flag is set to "1" at a time at which the engine is started. In the case where the engine is started, the routine goes to step S2. That is to say, since the stratified combustion enable flag=1 in the flow of the fuel injection control, the engine driving condition falls in the stratified combustion area shown in FIG. 2, and, therefore, the engine carries out the stratified combustion drive, the result thereof is utilized at a later time.

Then, the routine goes to a step S3 if the engine carries out the stratified combustion drive at step S2 (Yes). At step S3, engine controller 11 refers to a map (a counter increment value map) shown in FIG. 6 on the basis of the instantaneous engine speed and engine load to calculate the increment value of the counter. At the next step S4, engine controller 11 adds the increment value to the counter. It is noted that during the engine drive start the count value of the counter is initialized to be zero. At the next step S5, engine controller 11 determines if the count value of the counter is equal to or higher than the upper limit value KSBFULL of the counter. The upper limit value of KSBFULL of the counter defines the count value of the counter which forcibly inhibits the stratified combustion drive. The value of KSBFULL is constant and its setting method has already been described with reference to FIGS. 11 and 13.

At an initial time at which the stratified combustion drive is started, the value of the counter is smaller than the upper limit value KSBFULL of the counter, the routine goes to step S2 and the series of processes of steps S2, S3, S4, and S5 is repeated. During the series of processes, the value of the counter is gradually made larger. If the value of the counter becomes equal to or larger than upper limit value of KSBFULL of the counter, the routine goes to a step S6 from step S5. At step S6, engine controller 11 resets the stratified combustion enable flag to zero in order to inhibit the stratified combustion drive. Consequently, the combustion state is forcibly switched to the homogenous combustion drive.

Steps S7 through S10 are a control (recovery control) in a state where the drive state is forcibly switched to the homogenous combustion drive. At step S7, engine controller 11 refers to a map (a counter decrement value map) shown in FIG. 8 on the basis of the instantaneous engine speed and engine load to calculate the decrement value of the counter. This decrement value is subtracted from the value of counter at step S8.

At step S9, engine controller 11 determines if the count value of the counter is equal to or smaller than lower limit value KSBOK of the counter. Lower limit value KSBOK of the counter defines the value of the counter that allows the stratified combustion and is constant in the same way as KSBFULL.

Immediately after the switching to the homogeneous combustion drive, the value of the counter is larger than lower limit value KSBOK of the counter. Hence, the routine returns to step S7 and the series of steps S7, S8, and S9 is repeated. In the series of processes of steps S7 through S9, the value of the counter becomes gradually small.

Then, if the value of the counter becomes equal to or below the lower limit value KSBOK of the counter, the routine goes from step S9 to step S10. In order to allow the stratified combustion, engine controller 11 sets the stratified combustion enable flag to "1" at step S10. It is noted that after the stratified combustion enable flag=1, the combustion state in the fuel injection control flow is transferred to the combustion belonging to the instantaneous engine driving condition. That is to say, if the driving condition falls in the stratified combustion area, the drive state is returned to the stratified combustion drive state, the homogenous combustion drive is continued without the state transfer.

On the other hand, the stratified combustion drive is not often carried out even if the stratified combustion is allowed (enabled). This occurs when the instantaneous engine driving condition falls in the homogenous combustion region even if the stratified combustion drive is allowed (enabled). In this case, the routine goes from step S2 to steps S11 and S12. Engine controller 11 refers to the map (counter decrement value map) shown in FIG. 8 on the basis of the instantaneous engine speed and load to calculate the decrement value of the counter. Then, the counter is decremented by the decrement value. Unless the engine driving condition falls within the homogenous combustion region shown in FIG. 2, the steps S11 and S12 are repeated. At a timing at which the engine driving condition is varied so as to be transferred to the stratified combustion region, the routine goes from step S2 to step S3.

Figure 10:
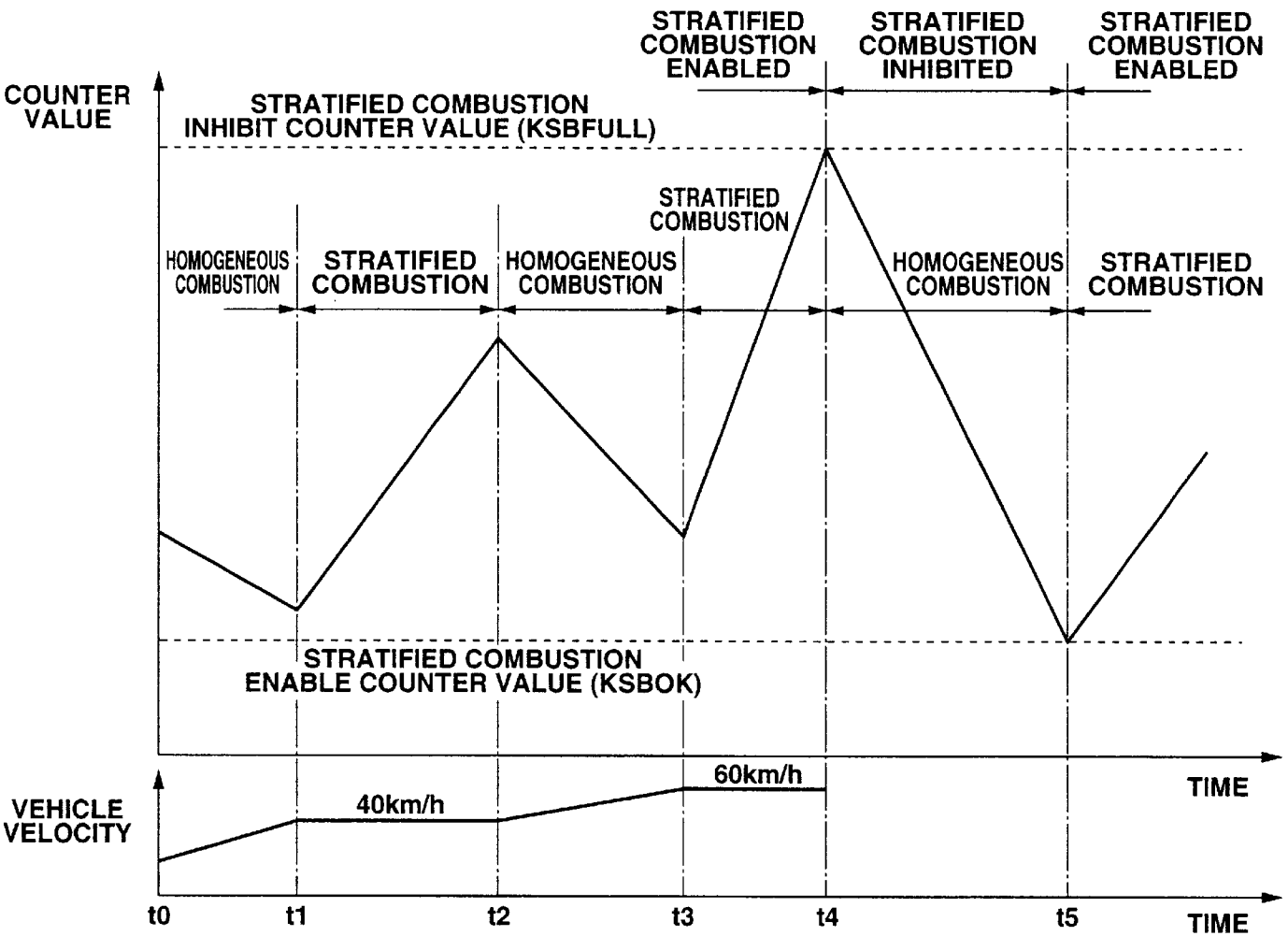
FIG. 10 is a waveform chart for explaining the operation of the combustion control apparatus in the preferred embodiment.

Next, an operation of the combustion control apparatus in the preferred embodiment will be described with reference to FIG. 10. FIG. 10 shows a combustion switching state when an acceleration is carried out at a time point of t0 under the stratified combustion enabled state to accelerate the vehicle, the vehicle speed of 40 km/h is maintained at a time point t1, the acceleration is again carried out at a time point t2, and the vehicle enters a cruise speed run of 60 Km/h at a time point of t3.

In this case, the value of the counter is increased since the stratified combustion drive is carried out over the stratified combustion region of the driving condition at time intervals of t1 to t2 and t3 to t4 which are constant cruise intervals. This means that when the stratified combustion is continued, the carbon is deposited on the surface of the tip portion 21*a* of center electrode 21 and insulator porcelain 22 so that a thickness of deposited carbon is gradually increased. Consequently, this means that the insulation resistance becomes reduced. It is noted that the value of the counter is decreased since the engine driving condition is transferred to the homogenous combustion region at the intervals of t0 to t1 and t2 to t3 which are acceleration intervals. Consequently, the insulation resistance value becomes reduced. It is noted that since the driving condition is transferred to the homogenous combustion drive is carried out, the value of the counter is decreased. The value of the counter reaches to the upper limit value KSBFULL of the counter at a time point of t4. Time point of t4 indicates immediate prior state (so called, smolder immediate prior state)after which the deposited carbon become thicker to some degree and, if the carbon becomes more thicker, the smolder would be developed. If the value of the counter becomes equal to or higher than KSBFULL, the smolder is developed and the combustion stability becomes worsened.

The value of the counter becomes reduced since the stratified combustion drive is inhibited and the stratified combustion drive is forcibly switched to the homogeneous combustion drive. This means that the count value of the counter becomes reduced. In addition, this means that, if the homogenous combustion drive is continued, the autopurification causes carbons deposited on surfaces of tip portion 21*a* of center electrode 21 and of the insulator porcelain 22 to be gradually vanish so that the insulation resistance of spark plug is continued to be recovered to the normal (ordinary) state. Thereafter, the value of counter reaches to lower limit value KSBOK of the counter at a time t5. A time point of t5 indicates a state in which almost all of the deposited carbon vanishes, the insulation resistance is recovered to the ordinary state, and the combustion stability is secured. If the combustion state falls in a stratified combustion region at a time point of t5, the continuation of the homogenous combustion provides a cause of worsening of the fuel economy. At this time, the stratified combustion is enabled and the stratified combustion drive having an improved fuel economy is resumed if the instantaneous engine driving condition falls in the stratified combustion region. As described above, since the counter corresponding to the drive time duration until it reaches to the smolder immediate prior state during the stratified combustion drive in this embodiment is introduced, engine controller 11 determines whether it reaches to a time to inhibit the stratified combustion drive on the basis of the count value of the counter and switches forcibly into the homogenous combustion drive when determining that it reaches to the time for the stratified combustion drive to be inhibited, the worsening of the combustion stability can be suppressed at minimum as compared with the method of detecting the misfire according to the secondary voltage.

In addition, since the increment value of the counter (a rate of increment of the counter) is varied so as to correspond to the drive time duration until the smolder immediate prior state which is different according to the driver condition (engine load and engine speed), the ignition state can accurately be retained in the smolder immediate prior state even if the driving condition is varied in the stratified combustion drive region. Although there are various parameters in factors which influence the smolder of the spark plug, the increment value of the counter is determined according to the engine speed and engine load. Hence, the increment value of the counter, in this embodiment, is determined according to the engine speed and engine load. Hence, the increment value of the counter can be determined by a lowest limit of parameters of the engine speed and engine load. Since the increment value of the counter is set according to the map of the engine speed and engine load, the calculation load of control is reduced and a control response characteristic is improved.

In addition, although, in the embodiment, the value of the counter is compared with the upper limit value of the counter, the upper limit value of the counter is set on the basis of the value of the counter corresponding to the longest time duration from among the drive time durations until it reaches to the smolder immediate prior state. Hence, the single upper limit value of the counter is enough even if the driving condition is different to determine easily the timing at which the stratified combustion drive is inhibited.

Furthermore, in a case where the stratified combustion drive is inhibited but the homogenous combustion drive is carried out, the counter which corresponds to the drive time duration until the recovery of the insulation resistance to its ordinary (normal) value is introduced, engine controller 11 determines whether it reaches to a time point at which the inhibit of the stratified combustion drive is released when determining that it reaches to a time point at which the inhibit of the stratified combustion drive is released, the recovery of the insulation resistance of the spark plug can quickly be carried out.

Thus, the excessive elongation of the time duration at which the stratified combustion drive is inhibited can be suppressed as compared with a case where a time duration for which the homogenous combustion drive has been carried out is counted and, when the counted value has reached to a constant value irrespective of the driving condition, the inhibit of the stratified combustion drive is released. Since the decrement value of the counter (decrement rate of the counter) is varied so as to correspond to the drive time duration until the recovery of the insulation resistance of the spark plug, the insulation resistance of the spark plug can accurately be recovered even if the driving condition is varied in the homogenous combustion drive region and an excessive loss of an opportunity such that the stratified combustion drive is possible can be suppressed.

Although there are various parameters in factors which influence the recovery of the insulation resistance of the spark plug, in this embodiment, the decrement value of the counter is determined according to the engine speed and engine load. The decrement value of the counter is determined by a minimum number of parameters, viz., the engine speed and engine load.

In addition, since the decrement value of the counter is set according to the map related to the engine speed and engine load, the load of calculation on the control is reduced and the control response characteristic can be improved.

Since, in the case where the value of the counter to determine a time at which the inhibit of the stratified combustion drive is released is compared with the lower limit value of the counter, the lower limit value of the counter is set on the basis of the value of the counter which corresponds to the longest time duration from among the drive time durations until the recovery of the insulation resistance of the spark plug which are different according to the driving condition, the single lower limit value is enough to determine easily the time at which the inhibit of the stratified combustion drive is released.

As described above, the counter which corresponds to the drive time duration until the smolder immediate prior state during the stratified combustion drive is introduced, engine controller determines whether it reaches to the time at which the stratified combustion drive is inhibited on the basis of the value of the counter, forcibly switches the combustion drive to the homogenous combustion drive when determining that it reaches to the time at which the stratified combustion drive is inhibited, the counter which corresponds to the drive time duration for the insulation resistance to be recovered to the normal value during the homogenous combustion drive after the combustion drive is forcibly switched to the homogenous combustion drive is introduced, and engine controller releases the inhibit of the stratified combustion drive when determining that it reaches to the time at which the inhibit of the stratified combustion drive is released. Hence, the worsening of the combustion stability during the homogeneous combustion drive can be suppressed at minimum and the excessive long time duration for which the homogeneous combustion drive is carried out after the switch to the homogenous combustion drive can be eliminated. Consequently, the stratified combustion drive can be carried out for a time duration which is as long as possible within a range in which the combustion stability is not worsened and an actual fuel economy can more remarkably be improved.

Although, in this embodiment, the reduction of the insulation resistance of the spark plug during the homogenous combustion drive is represented by the increase in the numerical value and the recovery of the insulation resistance of the spark plug is represented by the decrease in the numerical value, the reduction of the insulation resistance of the spark plug during the homogenous combustion drive may, in turn, be represented by the decrease in the numerical value, and the recovery of the insulation resistance of the spark plug during the homogenous combustion drive may be represented by the increase in the numerical value.

It is noted that the number of divisions of the regions of a regional view representing a distribution of the recovery speed of the insulation resistance value during the homogenous combustion drive are not limited.

Figure 8:
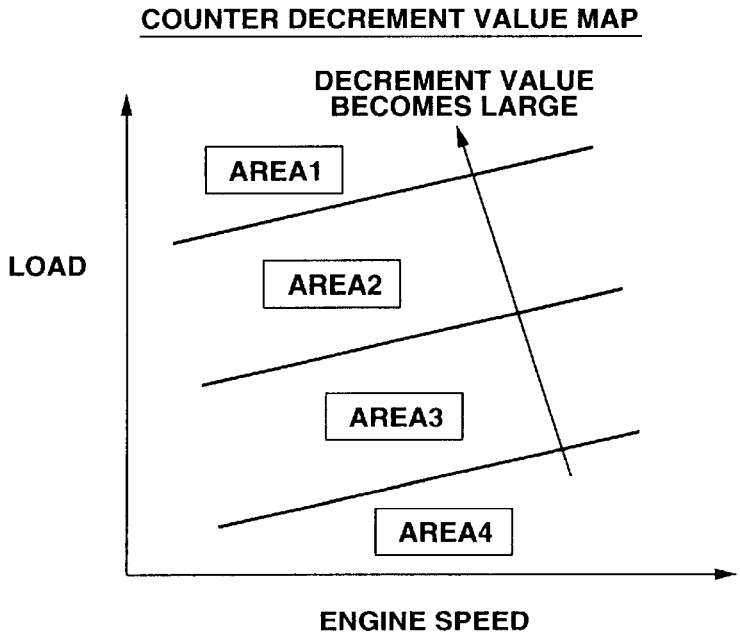
FIG. 8 is a characteristic graph representing a map of a value of decrement of the counter.

Although, in this embodiment, both of the increment value of the counter and the decrement value thereof are made different for each drive region as shown in FIGS. 6 and 8, the increment value of the counter and the decrement value thereof may simply be constant over the whole driving region.

The entire contents of Japanese Patent Applications No. 2001-162130 (filed in Japan on May 30, 2001) are herein incorporated by reference. The scope of the invention is defined with reference to the following claims.

What is claimed is:

1. A combustion control apparatus for a spark-ignited internal combustion engine, comprising:

a counter set to correspond to a drive time duration from a time at which a combustion drive state of the engine is started to be in a stratified combustion drive state to a time immediately before a smolder of a spark plug occurs in a state of which a spark is emitted between an outer electrode of the spark plug and a carbon deposited on an insulator porcelain thereof;

an inhibit timing determining section that determines whether it reaches to a time at which the stratified combustion drive state is inhibited on the basis of a value of the counter; and a combustion drive state switching section that switches forcibly the combustion drive state from the stratified combustion drive state to a homogeneous combustion drive state when the inhibit timing determining section determines that it reaches to the time at which the stratified combustion drive state is inhibited.

2. A combustion control apparatus for a spark-ignited internal combustion engine as claimed in claim 1, wherein, in a case where the value of the counter is a value incremented so as to correspond to the drive time duration, a rate of increment of the counter is varied according to the drive time duration up to the time immediately before the smolder of the spark plug occurs.

3. A combustion control apparatus for a spark-ignited internal combustion engine as claimed in claim 2, wherein the rate of increment of the counter becomes increased as a load of the engine becomes higher.

4. A combustion control apparatus for a spark-ignited internal combustion engine as claimed in claim 2, wherein the rate of increment of the counter becomes increased as a speed of the engine becomes lower.

5. A combustion control apparatus for a spark-ignited internal combustion engine as claimed in claim 2, wherein the rate of increment of the counter is determined according to a speed of the engine and a load thereof.

6. A combustion control apparatus for a spark-ignited internal combustion engine as claimed in claim 5, wherein the rate of increment of the counter is set using a map of a speed of the engine and a load thereof.

7. A combustion control apparatus for a spark-ignited internal combustion engine as claimed in claim 1, wherein the inhibit timing determining section comprises a comparing section that compares the value of the counter with an upper limit value of the counter, an upper limit value of the counter being set on the basis of a value of the counter corresponding to a longest time duration from among a plurality of the drive time durations to the time immediately before the smolder of the spark plug occurs which are different from one another according to an engine driving condition.

8. A combustion control apparatus for a spark-ignited internal combustion engine, comprising:

a counter set to correspond to a drive time duration from a time at which a stratified combustion drive state is inhibited to a time at which an insulation resistance of the spark plug is recovered to its original resistance value during a homogenous combustion drive state;

a release timing determining section that determines whether it reaches to a time at which the inhibit of the stratified combustion drive state is released on the basis of a value of the counter; and a release section that releases the inhibit of the stratified combustion drive when the release timing determining section determines that the inhibit of the stratified combustion drive is released.

9. A combustion control apparatus for a spark-ignited internal combustion engine as claimed in claim 8, wherein, in a case where the value of the counter is decremented so as to correspond to the drive time duration, a rate of decrement of the counter is varied according to a plurality of the drive time durations to the time at which the insulation resistance of the spark plug is recovered to its original value which are different from one another according to an engine driving condition.

10. A combustion control apparatus for a spark-ignited internal combustion engine as claimed in claim 9, wherein the rate of decrement of the counter becomes increased as a load of the engine becomes higher.

11. A combustion control apparatus for a spark-ignited internal combustion engine as claimed in claim 9, wherein the rate of decrement of the counter becomes increased as a speed of the engine becomes higher.

12. A combustion control apparatus for a spark-ignited internal combustion engine as claimed in claim 9, wherein the rate of decrement of the counter is determined according to a speed of the engine and a load thereof.

13. A combustion control apparatus for a spark-ignited internal combustion engine as claimed in claim 12, wherein the rate of decrement of the counter is set using a map of the speed of the engine and the load thereof.

14. A combustion control apparatus for a spark-ignited internal combustion engine as claimed in claim 8, wherein, in a case where the release timing determining section comprises a comparing section that compares the value of the counter with a lower limit value of the counter, the lower limit value of the counter is set on the basis of the value of the counter corresponding to a longest time duration from among a plurality of the drive time durations to the time at which the insulation resistance of the spark plug is recovered to its original value which are different from one another according to the engine driving condition.

15. A combustion control apparatus for a spark-ignited internal combustion engine, comprising:

a first counter set to correspond to a drive time duration from a time at which a combustion drive state of the engine is started to be in a stratified combustion drive state to a time immediately before a smolder of a spark plug occurs in a state of which a spark is emitted between an outer electrode of the spark plug and a carbon deposited on an insulator porcelain thereof an inhibit timing determining section that determines whether it reaches to a time at which the stratified combustion drive state is inhibited on the basis of a value of the counter;

a combustion drive state switching section that switches forcibly the combustion drive state from the stratified combustion drive state to a homogeneous combustion drive state when the inhibit timing determining section determines that it reaches to the time at which the stratified combustion drive state is inhibited;

a second counter set to correspond to a drive time duration from a time at which the combustion drive state switching section forcibly switches the combustion drive state from the stratified combustion drive state to the homogenous combustion drive state to a time at which an insulation resistance of the spark plug is recovered to its original resistance value during the homogenous combustion drive state;

a release timing determining section that determines whether it reaches to a time at which the inhibit of the stratified combustion drive state is released on the basis of a value of the second counter; and a release section that releases the inhibit of the stratified combustion drive when the release timing determining section determines that the inhibit of the stratified combustion drive is released.

16. A combustion control apparatus for a spark-ignited internal combustion engine as claimed in claim 15, wherein the first counter comprises the same up-and-down counter as the second counter.

17. A combustion control apparatus for a spark-ignited internal combustion engine as claimed in claim 15, wherein an upper limit value of the first counter is set to be a predetermined multiple of a longest time duration from among a plurality of the drive time durations to the time immediately before the smolder of the spark plug occurs which are different from one another according to an engine driving condition.

18. A combustion control apparatus for a spark-ignited internal combustion engine as claimed in claim 17, wherein a lower limit value of the second counter is set to be another predetermined multiple of a longest time duration from among a plurality of the drive time durations to the time at which the insulation resistance of the spark plug is recovered to its original value which are different from one another according to the engine driving condition.

19. A combustion control apparatus for a spark-ignited internal combustion engine, comprising:

counting means for corresponding to a drive time duration from a time at which a combustion drive state of the engine is started to be in a stratified combustion drive state to a time immediately before a smolder of a spark plug occurs in a state of which a spark is emitted between an outer electrode of the spark plug and a carbon deposited on an insulator porcelain thereof;

inhibit timing determining means for determining whether it reaches to a time at which the stratified combustion drive state is inhibited on the basis of a value of the counter; and combustion drive state switching means for switching forcibly the combustion drive state from the stratified combustion drive state to a homogeneous combustion drive state when the inhibit timing determining means determines that it reaches to the time at which the stratified combustion drive state is inhibited.

20. A combustion control method for a spark-ignited internal combustion engine, comprising:

setting a counter to correspond to a drive time duration from a time at which a combustion drive state of the engine is started to be in a stratified combustion drive state to a time immediately before a smolder of a spark plug occurs in a state of which a spark is emitted between an outer electrode of the spark plug and a carbon deposited on an insulator porcelain thereof;

determining whether it reaches to a time at which the stratified combustion drive state is inhibited on the basis of a value of the counter; and switching forcibly the combustion drive state from the stratified combustion drive state to a homogeneous combustion drive state when determining that it reaches to the time at which the stratified combustion drive state is inhibited.

* * * * *